US006796838B2

(12) United States Patent
Yoshioka

(10) Patent No.: US 6,796,838 B2
(45) Date of Patent: Sep. 28, 2004

(54) SHIELD CONNECTOR DIRECTLY-MOUNTABLE ON EQUIPMENT

(75) Inventor: Nobuaki Yoshioka, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/123,187

(22) Filed: Apr. 17, 2002

(65) Prior Publication Data

US 2002/0155756 A1 Oct. 24, 2002

(30) Foreign Application Priority Data

Apr. 18, 2001 (JP) ..... P2001-119757

(51) Int. Cl.[7] ..... H01R 13/648
(52) U.S. Cl. ..... 439/607; 439/98; 439/610
(58) Field of Search ..... 439/607, 608, 439/609, 610, 92, 96, 559

(56) References Cited

U.S. PATENT DOCUMENTS 5,018,920 A * 5/1991 Speakman ..... 411/43
5,417,587 A * 5/1995 Katsuda et al. ..... 439/559
6,280,208 B1 * 8/2001 Masuda et al. ..... 439/98

FOREIGN PATENT DOCUMENTS

| | | |
|---|---|---|
| JP | 6-58560 | 8/1994 |
| JP | 2000-48912 | 2/2000 |
| JP | 2000-294344 A | 10/2000 |

* cited by examiner

*Primary Examiner*—Alex Gilman
(74) *Attorney, Agent, or Firm*—Sughrue Mion, PLLC

(57) ABSTRACT

Metal shells (35) are mounted on a connector housing (33), and a screw engagement hole (57) is formed through a grounding flange portion (52) of the metal shell (35) mated with a mounting flange (44) of the connector housing (33), and a screw (37) for fastening the mounting flange (44) to a mounting wall (38) of an equipment is passed through the screw engagement hole (57). Collars (75) are fitted respectively in collar insertion holes **(44*a*) in the mounting flange (44), and when each screw (37) is fastened, the grounding flange portion (52) is clamped between the mounting flange (44) and the mounting wall (38)**, and the collar presses this grounding flange against a grounding surface of an equipment.

9 Claims, 6 Drawing Sheets

SHIELD CONNECTOR DIRECTLY-MOUNTABLE ON EQUIPMENT

BACKGROUND OF THE INVENTION

1. Field of the Invention

This invention relates to a shield connector which is directly mountable on equipment, for example, on an electrically-conductive casing of an on-vehicle equipment by screws. Such the shield connector is generally referred hereinafter to "direct-mounting shield connector".

The present invention is based on Japanese Patent Application No. 2001-119757, which is incorporated herein by reference.

2. Related Art

FIGS. 8 and 9 show conventional direct-mounting shield connectors, respectively.

The direct-mounting shield connector 1, shown in FIG. 8, is disclosed in JP-U-6-58560, and this connector comprises a metal shell 5, having a cylindrical portion 5*a* for connection to a shielding portion 3*a* of a shielded wire 3, and a grounding flange portion 5*b*, and a connector housing 7 made of an insulative resin.

The connector housing 7 includes a housing body 11, which fits on and holds a connection terminal 9, connected to a conductor 3*b* of the shielded wire 3, and has the cylindrical portion 5*a* of the metal shell 5 embedded therein, and a mounting flange 12 which extends outwardly from an outer surface of the housing body 11 for screwing purposes.

A front end portion of the housing body 11 is passed through a connector passage hole 14*a*, formed through a connector mounting wall 14 of an equipment, and the mounting flange 12, abutted against the connector mounting wall 14, is fastened to this connector mounting wall by screws 16, thus fixedly securing the connector housing 7 to the connector mounting wall 14.

The metal shell 5 is fitted and held on the connector housing 7, and in this condition a rear end portion of the cylindrical portion 5*a* is electrically connected to the shielding portion 3*a* via a connection member 17, and the cylindrical portion 5*a* is embedded in the housing body 11.

The grounding flange portion 5*b* of the meta shell 5 is mated with that surface of the mounting flange 12 which is to be opposed to the connector mounting wall 14, and when the mounting flange portion 12 is screwed, the grounding flange portion 5*b* is electrically connected to the connector mounting wall 14.

As shown in FIG. 9, the direct-mounting shield connector, which is disclosed in JP-A-2000-48912, comprises a connector housing 23, which receives and holds a connection terminal 22 connected to a shielded wire, and a metal shell 25 which is separate from the connector housing, and is electrically connected to a shielding portion of the shielded wire. The connector housing 23 and the metal shell 25 are fastened together by screw members 27, with a connector mounting wall 26 of an equipment interposed therebetween, and by doing so, the connector housing 23 is fixedly secured to the connector mounting wall 26, and at the same time mounting piece portions 25*a* of the metal shell 25 are electrically connected to the connector mounting wall 26.

With respect to the connector housing 23, when a terminal receiving portion 23*a* is passed through a connector passage hole 26*a* formed through the connector mounting wall 26, the screw members 27, inserted in a mounting flange 23*b*, pass respectively through collar insertion holes 26*b* formed through the connector mounting wall 26.

However, in the direct-mounting shield connector 1 shown in FIG. 8, the mounting flange 12, made of the resin, is fastened to the connector mounting wall 14 by the screws, and the grounding flange portion 5*b* of the metal shell 5 is brought into contact with the connector mounting wall 14 of the equipment by a pressing force produced by the mounting flange 12. Thus, the grounding flange portion is not directly fastened to the connector mounting wall by the screws, and therefore it is difficult to achieve the firm electrical connection therebetween, and there has been encountered a problem that electrical connection characteristics of the grounding contact are liable to become unstable by a thermal shock, caused by heat generated in a vehicle on which the equipment is mounted, vibrations and others.

In the direct-mounting shield connector 21 shown in FIG. 9, the screw members 27 are passed respectively through the mounting piece portions 25*a* of the metal shell 25, and therefore fastening forces of the screw members 27 act directly on the mounting piece portions 25*a*, so that the firm electrical connection can be achieved. However, the connector housing 23 and the metal shell 25 are separate from each other, and therefore the connector housing 23 and the metal shell 25 are supported separately in predetermined positions, respectively, with the connector mounting wall 26 interposed therebetween, and in this condition the fastening operation must be carried out by the screw members 27, and therefore there has been encountered a problem that the efficiency of the mounting operation is low.

SUMMARY OF THE INVENTION

This invention has been made under the above circumstances, and an object of the invention is to provide a direct-mounting shield connector in which a metal shell can be so firmly electrically connected to a connector mounting wall that this electrical connection will not become unstable by a thermal shock, caused by heat generated in a vehicle, vibrations and others, and besides a connector housing and the metal shell can be mounted on the connector mounting wall from one side of the connector mounting wall so that the mounting operation can be carried out easily.

The above object has been achieved by a shield connector directly-mountable on an equipment comprising: a mounting flange provided in a connector housing and attachable to a mounting wall of the equipment by screwing; a metal shell having a cylindrical portion and a grounding flange portion which is clamped between the mounting flange and the mounting wall to thereby electrically connected to the mounting wall and on which a screw engagement hole for inserting a screw is formed; a collar fittingly inserted into a collar insertion hole formed on the mounting flange; wherein an end surface of the collar is brought into abutment with the grounding flange at a peripheral edge portion of the screw engagement hole, and the collar presses the grounding flange portion against the mounting wall when the screw passed through the collar is fastened.

In the above construction, when the connector housing is fastened to the mounting wall by the screws, the axial fastening force of each screw serves as a force to press the grounding flange portion, formed on the metal shell, against the mounting wall through the collar fitted in the collar insertion hole in the mounting flange of the connector housing.

Namely, the fastening force of each screw for fastening the connector housing to the mounting wall serves as a force to contact the grounding flange portion with the mounting wall, and acts directly on the grounding flange portion of the metal shell.

And besides, the metal shell is fitted in the connector housing, and is joined thereto in a unitary manner, and therefore the connector housing and the metal shell can be mounted on the mounting wall from one side of the mounting wall.

Preferably, in the shield connector of the above construction, the collar may include a collar cylindrical portion and an inner diameter of the screw engagement hole may be set to be larger than an inner diameter of the collar cylindrical portion and smaller than an outer diameter of the collar cylindrical portion.

DETAILED DESCRIPTION OF THE PREFERRED EMBODIMENTS

A preferred embodiment of a direct-mounting shield connector of the present invention will now be described in detail with reference to the drawings.

Figure 1:
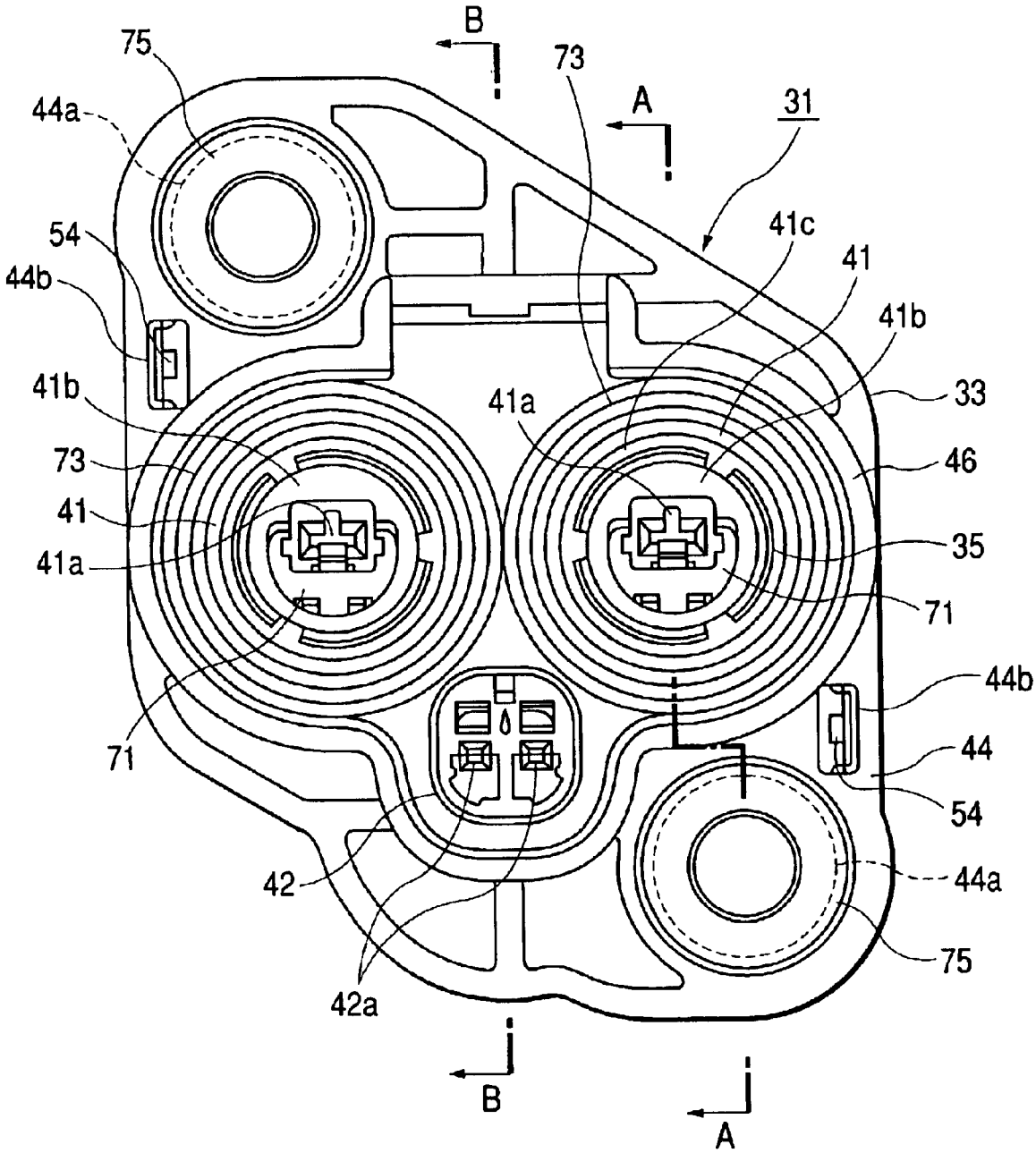
FIG. 1 is a front-elevational view of one preferred embodiment of a direct-mounting shield connector.
Figure 2:
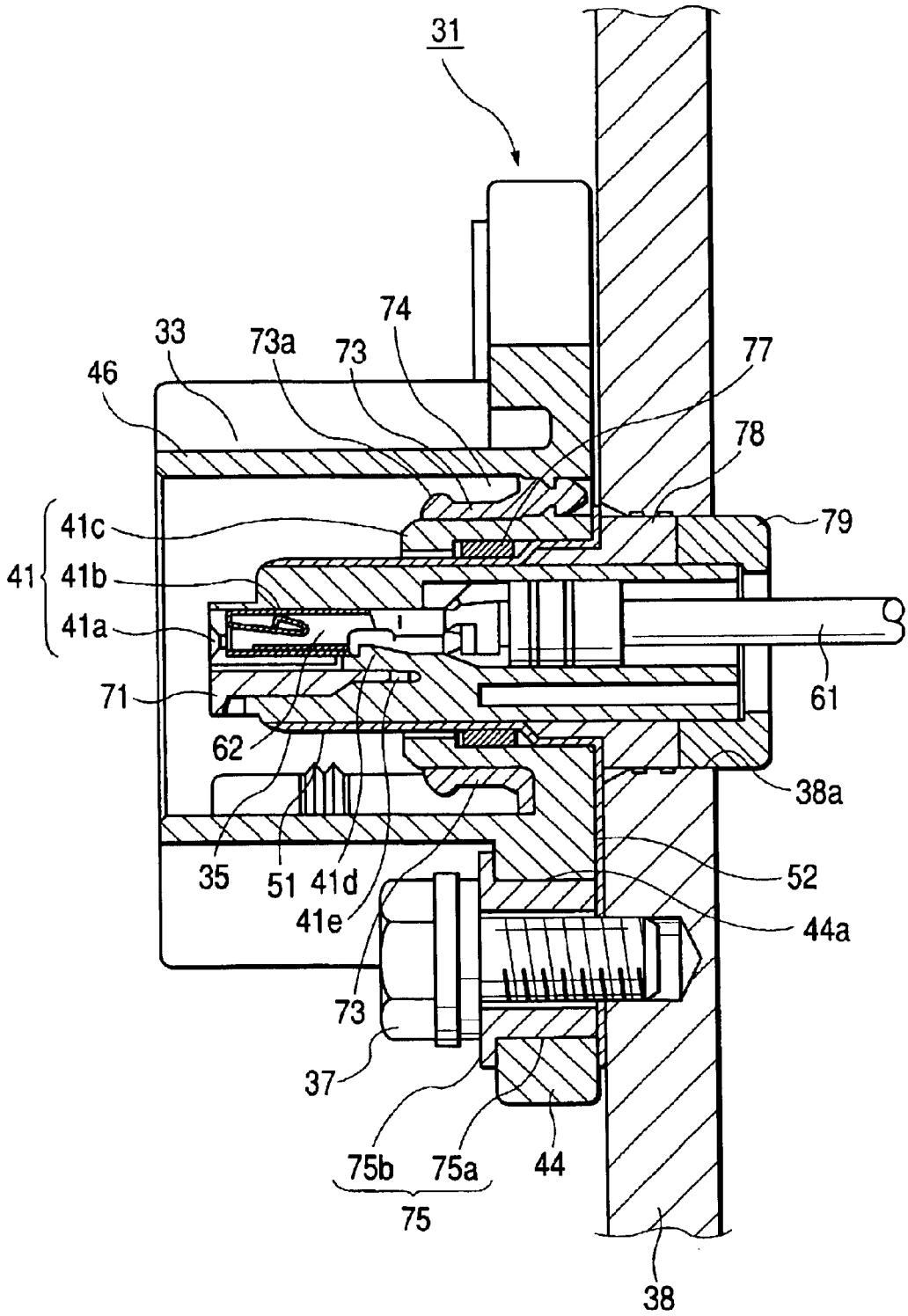
FIG. 2 is a cross-sectional view taken along the line A—A of FIG. 1.
Figure 3:
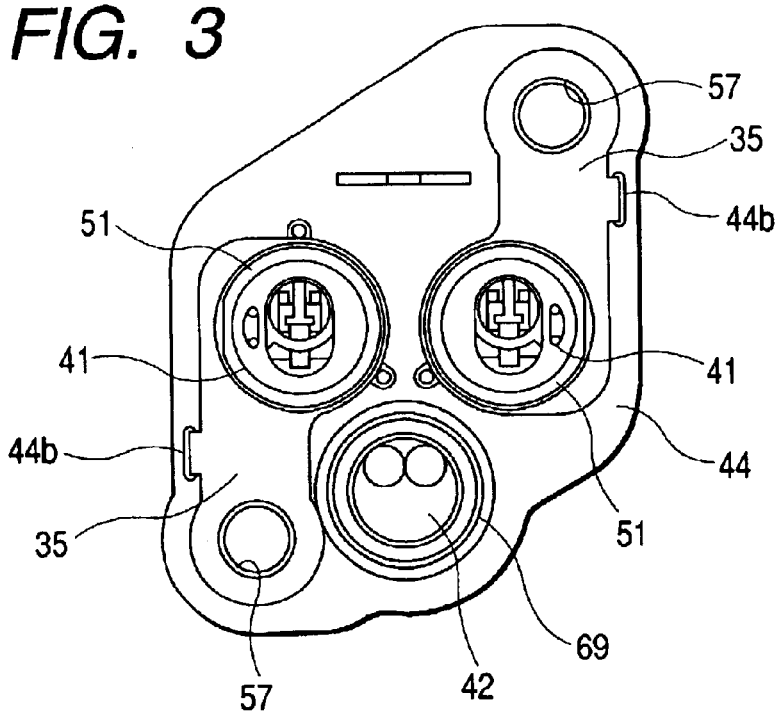
FIG. 3 is a rear view of the direct-mounting shield connector shown in FIG. 1.
Figure 4:
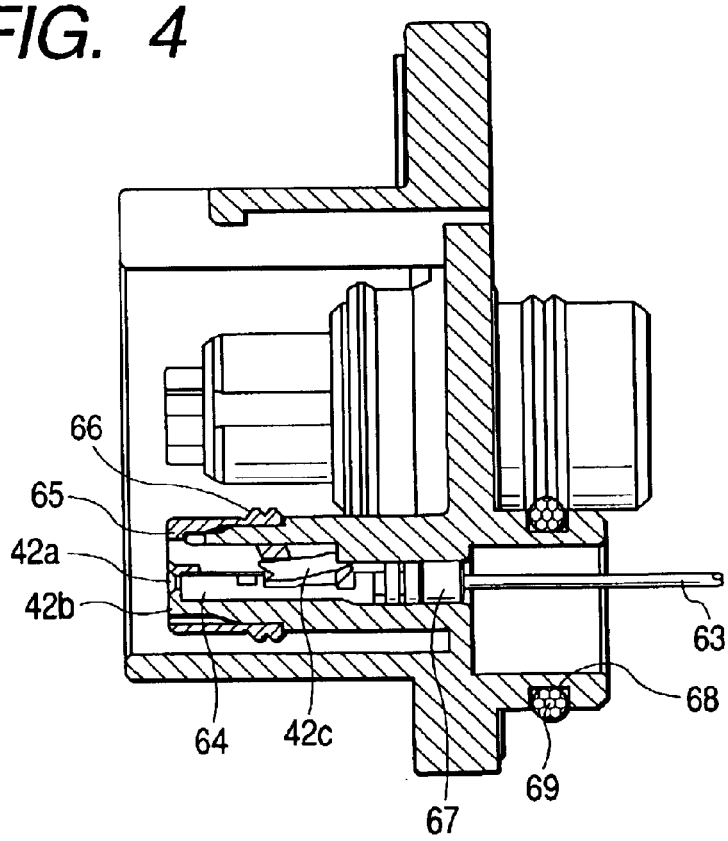
FIG. 4 is a cross-sectional view taken along the line B—B of FIG. 1.
Figure 5:
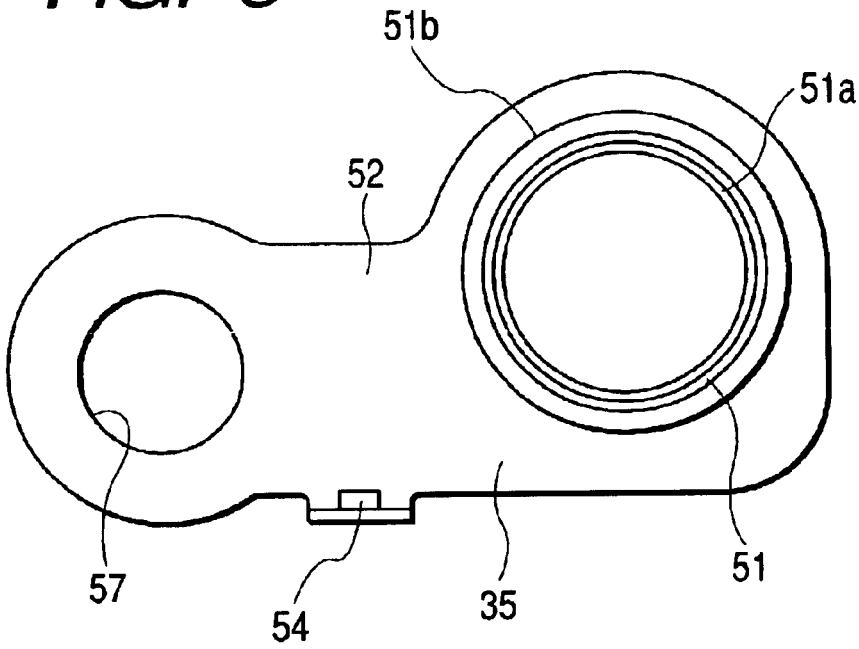
FIG. 5 is a top plan view of a metal shell used in the direct-mounting shield connector.
Figure 6:
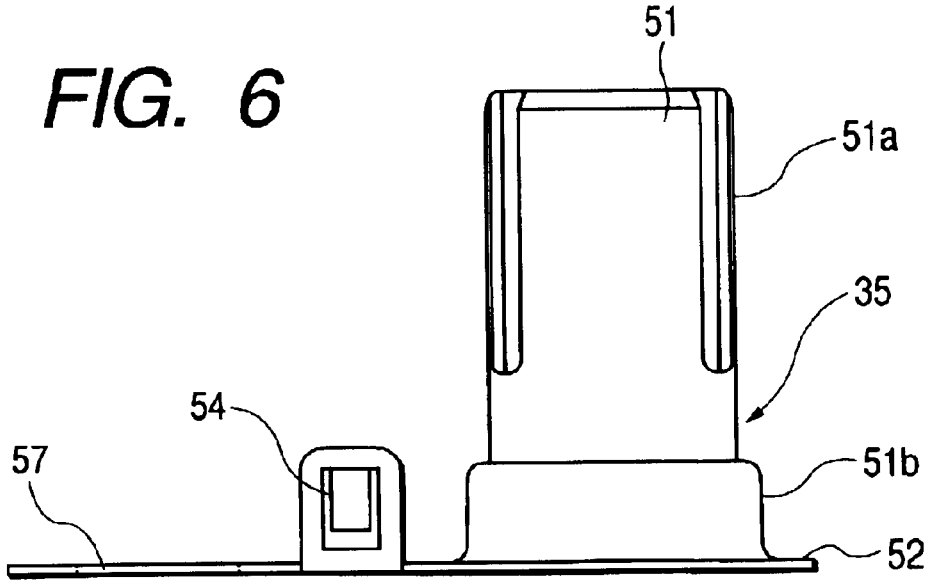
FIG. 6 is a side-elevational view of the metal shell shown in FIG. 5.
Figure 7:
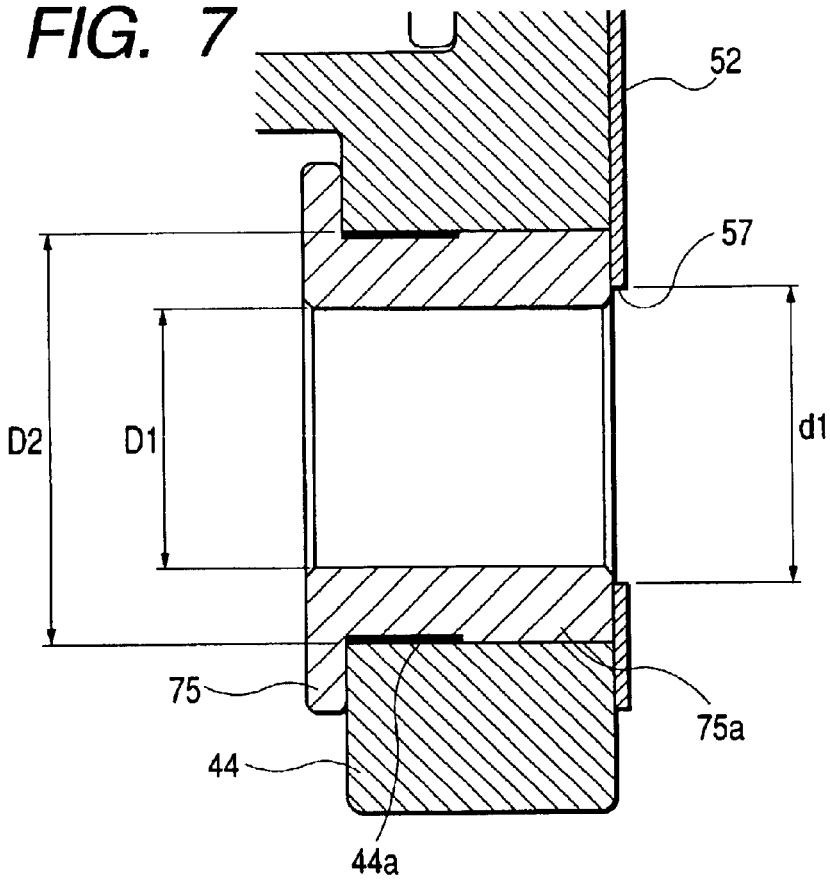
FIG. 7 is an enlarged view of an important portion of the direct-mounting shield connector shown in FIG. 1.
Figure 8:
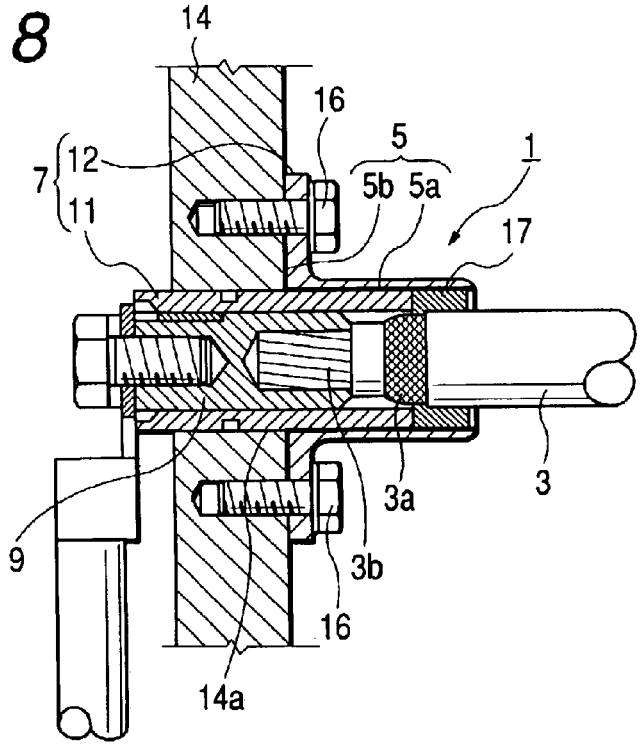
FIG. 8 is a vertical cross-sectional view of a conventional direct-mounting shield connector.
Figure 9:
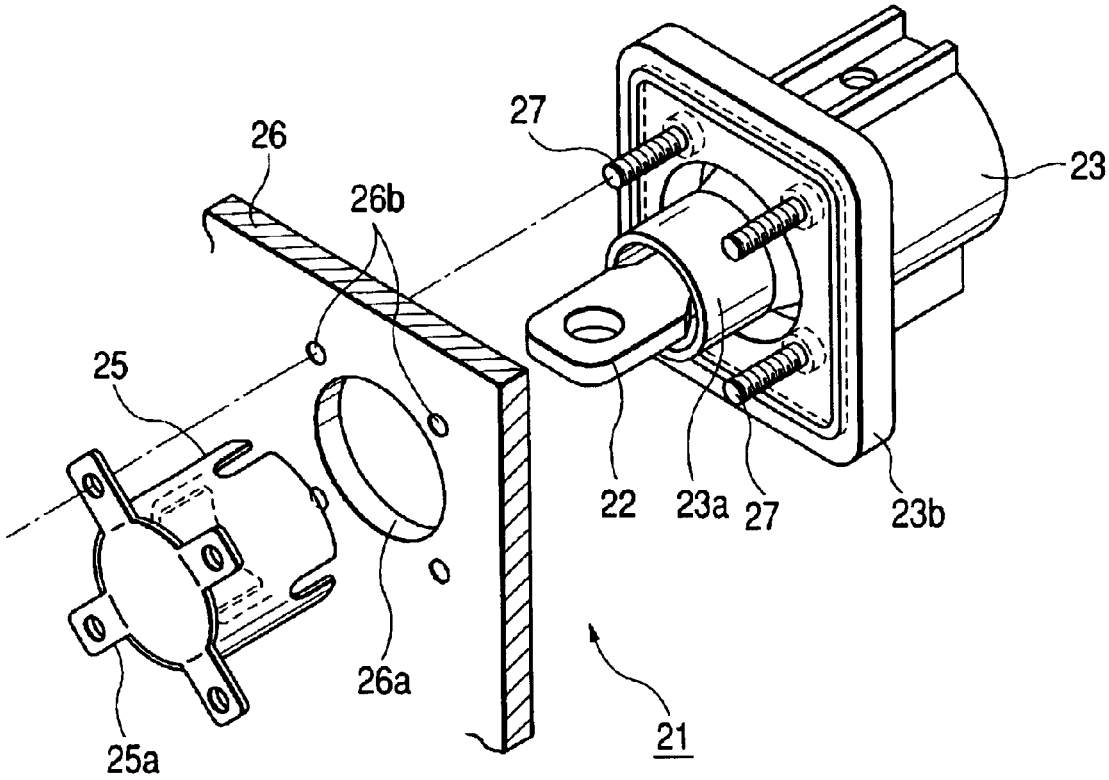
FIG. 9 is an exploded, perspective view of another conventional direct-mounting shield connector.

FIGS. 1 to 7 show one preferred embodiment of the direct-mounting shield connector of the invention, and FIG. 1 is a front-elevational view of the direct-mounting shield connector, FIG. 2 is a cross-sectional view taken along the line A—A of FIG. 1, FIG. 3 is a rear view of the direct-mounting shield connector shown in FIG. 1, FIG. 4 is a cross-sectional view taken along the line B—B of FIG. 1, FIG. 5 is a top plan view of a metal shell, FIG. 6 is a side-elevational view of the metal shell shown in FIG. 5, and FIG. 7 is an enlarged view of an important portion of the direct-mounting shield connector shown in FIG. 1.

The direct-mounting shield connector 31 is a connector used, for example, for connection to a shielded wire in an electric car, and this shield connector comprises a connector housing 33, made of an insulative resin, and metal shells 35 fitted in the connector housing 33, and is fixedly secured to a mounting wall 38 of an on-vehicle electrical equipment by screws 37.

The mounting wall 38 is a structural member of an electrically-conductive material such as a vehicle body frame, and the surface of this mounting-wall serves as a grounding surface to which a shielding portion of each shielded wire is electrically connected.

The connector housing 33 includes a pair of shielded wire bosses 41 each for connector-connection to the shielded wire and a power-supplying power terminal, a control boss 42 for connector-connection to a control wire and a terminal or the like, a mounting flange 44 for being screwed to the mounting wall 38, and a hood 46 formed perpendicularly on the mounting flange 44 in surrounding relation to the outer peripheries of the bosses 41 and 42. The connector housing 33 is integrally molded, using the insulative resin.

As shown in FIG. 2, each of the pair of shielded wire bosses 41 includes an inner tubular portion 41*b* of a substantially cylindrical shape, having a terminal receiving hole 41*a*, and an outer tubular portion 41*c* which is formed around this inner tubular portion 41*b*, and defines, together with this inner tubular portion, a gap through which a cylindrical portion 51 of the metal shell 35 passes.

The terminal receiving hole 41*a* receives and holds the female connection terminal 62 connected to a wire end portion 61 in the equipment.

A rear end portion (right end portion in FIG. 2) of each inner tubular portion 41*b* is passed through a corresponding housing passage hole 38*a* formed through the mounting wall 38. The inner tubular portion 41*b* has an elastic retaining piece portion 41*d* for retaining the connection terminal 62, this elastic retaining piece portion projecting into the terminal receiving hole 41*a*.

A holder fitting hole 41*e* is formed in a front end of the inner tubular portion 41*b*, and a front holder 71 is fitted into this holder fitting hole 41*e* from the front end side of this tubular portion.

This front holder 71 locks the retaining engagement of the elastic retaining piece portion 41*d* with the connection terminal 62, thereby preventing the withdrawal of the connection terminal 62 in a double manner.

The outer tubular portion 41*c* is concentric with the inner tubular portion 41*b*, and an annular seal 73 is closely fitted on the outer peripheral surface of this outer tubular portion. The annular seals 73 are mounted on the outer tubular portions 41*c*, respectively, and a connector fitting space 74, into which a mating connector can be fitted, is formed between each annular seal 73 and the hood 46. This connector fitting space 74 is a space into which a hood portion of the mating connector (not shown) for fitting connection to the shield wire bosses 41 can be fitted.

A lip portion 73*a* for intimate contact with the hood portion of the mating connector is formed in a bulged manner on an outer peripheral surface of the annular seal 73 at a front end thereof.

As shown in FIGS. 1 and 4, the control boss 42 includes a tubular portion 42*b* of a substantially square shape having two terminal receiving holes 42*a* serving as connection portions to which two control wires are connector-connected, respectively. Each of the terminal receiving holes 42*a* receives and holds a female connection terminal 64 which passes through a rubber plug 67, and is connected to a wire end portion 63 in the equipment.

A rear end portion (right end portion in FIG. 4) of the tubular portion 42*b* is passed through a housing passage hole (not shown) formed through the mounting wall 38. The tubular portion 42*b* has elastic retaining piece portions 42*c* for respectively retaining the connection terminals 64, each of these elastic retaining piece portion projecting into the corresponding terminal receiving hole 42*a*.

A front holder 65, which locks the retaining engagement of each elastic retaining piece portion 42*c* with the corresponding connection terminal 64 in a double manner to prevent the withdrawal of the connection terminals 64, is fitted into the front end of the tubular portion 42*b* from the front side thereof.

An annular packing 66 is closely fitted on the outer peripheral surface of the tubular portion 42*b* at a front end portion thereof, and this packing forms an airtight seal between the tubular portion 42*b* and a hood portion of a mating connector (not shown) fittingly connected to the control boss 42.

An O-ring groove 68 is formed in the outer peripheral surface of the tubular portion 42 at the rear end portion thereof, and an O-ring 69 is closely fitted in this O-ring groove 68, and the tubular portion 42*b* is passed through the housing passage hole (not shown), formed through the mounting wall 38, in a waterproof manner.

As shown in FIG. 1, the hood 46 is formed perpendicularly on the mounting flange 44 in surrounding relation to the outer peripheries of the pair of shielded wire bosses 41 and control boss 42.

The mounting flange 44 of a plate-like shape interconnects the rear ends of the bosses 41 and 42, and a pair of collar insertion holes 44*a*, as well as shell retaining holes 44*b*, are formed respectively through diagonally-opposite portions of this mounting flange 44.

The screws 37 are passed through the collar insertion holes 44*a*, respectively, and an inner diameter of each collar insertion hole 44*a* is larger than an outer diameter of the screw 37, and a collar 75 with a flange is fitted in the collar insertion hole 44*a*.

This collar 75 is so configured that its tubular portion 75*a*, fitted in the collar insertion hole 44*a*, has an inner diameter slightly larger than the outer diameter of the screw 37, and that the flange 75*b* is clamped between the mounting flange 44 and a head of the screw 37.

As shown in FIGS. 5 and 6, the metal shell 35 includes the cylindrical portion 51 for connection to the shielding portion of the shielded wire, a grounding flange portion 52, formed on and extending outwardly from a proximal end of the cylindrical portion 51, and a resilient retaining piece portion 54 which is formed perpendicularly on the grounding flange portion 52, and can be engaged in the shell retaining hole 44*b*. The metal shell 35 is formed by pressing.

The cylindrical portion 51 includes a smaller-diameter portion 51*a* for fitting on the inner tubular portion 41*b* of the shielded wire boss 41, and an enlarged-diameter portion 51*b* which extends from a proximal end of this smaller-diameter portion, and is so enlarged in diameter as to contact the inner peripheral surface of the outer tubular portion 41*c*.

The grounding flange portion 52 has a screw engagement hole 57 for passing the screw 37 therethrough, and is clamped between the mounting flange 44 and the mounting wall 38.

As shown in FIG. 7, an inner diameter d1 of the screw engagement hole 57 is so determined as to satisfy the formula, $D1<d1<D2$, wherein D1 represents the inner diameter of the tubular portion 75*a* of the collar 75, and D2 represents the outer diameter of this tubular portion 75*a*. The axial dimension of the tubular portion 75*a* of the collar 75 is so determined that an end surface of the tubular portion 75*a*, passed through the collar insertion hole 44*a*, is abutted against a peripheral edge portion of the screw engagement hole 57.

The cylindrical portion 51 is fitted in the inner tubular portion 41*b* of the shielded wire boss 41, and the resilient retaining piece portion 54 is engaged in the shell retaining hole 44*b* in the mounting flange 44, and by doing so, the metal shell 35 is joined to the connector housing 33.

As shown in FIG. 2, an annular packing 77 is provided in a gap between the smaller-diameter portion 51*a* of the cylindrical portion 51 and the outer tubular portion 41*c* is, and a packing 78 is provided in a gap, formed between the enlarged-diameter portion 51*b* of the cylindrical portion 51 and the inner tubular portion 41*b*, and a gap between the inner surface of the housing passage hole 38*a* and the inner tubular portion 41*b*, and the waterproof protection against the interior of the mounting wall 38 is secured by these packing members.

The packing 77 is held against withdrawal by a rear holder 79 fixed to the end portion of the inner tubular portion 41*b*.

With respect to the control boss 42, similarly, the waterproof protection against the interior of the mounting wall 38 is secured by the annular packing 66, mounted on the tubular portion 42*b*, the rubber plug 67, fitted on the terminal 64, and the O-ring 69 sealing the gap between the rear end portion of the tubular portion 42*b* and the inner surface of the housing passage hole, as shown in FIG. 4.

In the above direct-mounting shield connector 31, when the connector housing 33 is fastened to the mounting wall 38 by the screws 37, the axial fastening force of each screw 37 serves as a force to press the grounding flange portion 52 of the metal shell 35 against the grounding surface of the mounting wall 38 through the collar 75 fitted in the collar insertion hole 44*a* in the mounting flange 44.

Namely, the fastening force of each screw 37 for fastening the connector housing 33 to the mounting wall 38 serves as a force to contact the grounding flange portion 52 with the grounding surface, and acts directly on the metal shell 35, and therefore each metal shell 35 can be so firmly electrically connected to the grounding surface that the electrical connection characteristics will not become unstable by a thermal shock, caused by heat generated in the vehicle, vibrations and others.

And besides, the metal shells 35 are fitted in the connector housing 33, and are joined thereto in a unitary manner, and therefore the connector housing 33 and the metal shells 35 can be mounted on the mounting wall 38 from one side of the mounting wall 38 so that the mounting operation can be carried out easily.

In the direct-mounting shield connector of the present invention, the number of the shielded wire bosses 41 and the number of the screwing portions of the connector housing 33 are not limited to those of the above embodiment.

In the direct-mounting shield connector of the present invention, when the connector housing is fastened to the mounting wall by the screws, the axial fastening force of each screw serves as a force to press the grounding flange portion of the metal shell against the grounding surface of the mounting wall through the cylindrical collar fitted in the collar insertion hole in the connector housing.

Namely, the fastening force of each screw for fastening the connector housing to the mounting wall serves as a force to contact the grounding flange portion with the grounding surface, and acts directly on the metal shell, and therefore each metal shell can be so firmly electrically connected to the grounding surface that the electrical connection characteristics will not become unstable by a thermal shock, caused by heat generated in the vehicle, vibrations and others.

And besides, the metal shells are fitted in the connector housing, and are integrated thereto, and therefore the connector housing and the metal shells can be mounted on the mounting wall from one side of the mounting wall so that the mounting operation can be carried out easily.

What is claimed is:

1. A shield connector directly-mounted on an equipment and adapted for connecting to a mating connector having a hood portion, comprising:

a connector housing in which a connection terminal is provided, said connector housing including a mounting flange attachable to a mounting wall of the equipment by screwing;

a metal shell having a cylindrical portion, which is exposed for connecting to a part of said mating connector when said shield connector is fitted to said hood portion of said mating connector, and a grounding flange portion, which is clamped between said mounting flange and said mounting wall to thereby electrically connect to said mounting wall and on which a screw engagement hole for inserting a screw is formed;

a collar fittingly inserted into a collar insertion hole formed on said mounting flange;

wherein an end surface of said collar is brought into abutment with said grounding flange at a peripheral edge portion of said screw engagement hole, and said collar presses said grounding flange portion against said mounting wall when said screw passed through said collar is fastened.

2. A shield connector according to claim 1, wherein said collar includes a collar cylindrical portion and an inner diameter of said screw engagement hole is set to be larger than an inner diameter of said collar cylindrical portion and smaller than an outer diameter of said collar cylindrical portion.

3. A shield connector according to claim 1, wherein the cylindrical portion of said metal shell is operable to connect to a shielding portion of a shielded wire.

4. A shield connector according to claim 1, wherein the screw engagement hole has a uniform diameter.

5. A shield connector according to claim 1, wherein said connector housing is provided with a boss portion for connecting to said mating connector including an inner tubular portion in which a terminal receiving hole receiving said connection terminal is formed and an outer tubular portion through which said cylindrical portion of said metal shell is inserted, and said cylindrical portion is fitted with a first packing to said outer tubular portion.

6. A shield connector according to claim 5, wherein said inner tubular portion is inserted and fitted with a second packing to a housing passage hole formed on said mounting wall.

7. A shield connector according to claim 1, wherein the grounding flange portion of said metal shell is formed on and extends outwardly from a proximal end of the cylindrical portion.

8. A shield connector according to claim 7, wherein said metal shell further comprises a resilient retaining portion which is provided perpendicularly on the grounding flange portion.

9. A shield connector according to claim 8, wherein the cylindrical portion comprises a first diameter portion and a second diameter portion, the first diameter portion being smaller in diameter than the second diameter portion.

* * * * *